US006485633B2

(12) United States Patent
Wismann et al.

(10) Patent No.: US 6,485,633 B2
(45) Date of Patent: Nov. 26, 2002

(54) PROCESS FOR THE DEMERCAPTANIZATION OF PETROLEUM DISTILLATES

(75) Inventors: William Wismann, Camarillo, CA (US); Santosh K. Gangwal, Cary, NC (US)

(73) Assignee: DS2 Tech, Inc., Savanna, IL (US)

( * ) Notice: Subject to any disclaimer, the term of this patent is extended or adjusted under 35 U.S.C. 154(b) by 0 days.

(21) Appl. No.: 09/735,834

(22) Filed: Dec. 13, 2000

(65) Prior Publication Data

US 2002/0130062 A1 Sep. 19, 2002

Related U.S. Application Data

(60) Provisional application No. 60/170,422, filed on Dec. 13, 1999.

(51) Int. Cl.[7] ..... C10G 25/00; C10G 25/12

(52) U.S. Cl. ..... 208/307; 208/208 R; 208/213; 208/189; 208/196

(58) Field of Search ..... 208/208 R, 213, 208/189, 196, 307

(56) References Cited

U.S. PATENT DOCUMENTS

| | | | | |
|---|---|---|---|---|
| 1,998,863 A | | 4/1935 | Chaney et al. | |
| 2,324,927 A | | 7/1943 | Heilman | |
| 2,966,453 A | | 12/1960 | Gleim et al. | |
| 4,243,551 A | | 1/1981 | Ward | |
| 4,250,022 A | | 2/1981 | Frame | |
| 4,378,305 A | | 3/1983 | Carlson | |
| 4,481,107 A | * | 11/1984 | Urban | 208/206 |
| 4,675,100 A | * | 6/1987 | Maple et al. | 208/203 |
| 4,824,818 A | * | 4/1989 | Bricker et al. | 502/163 |
| 5,633,216 A | * | 5/1997 | Marcilly et al. | 502/66 |
| 5,726,118 A | * | 3/1998 | Ivey et al. | 502/417 |
| 5,741,415 A | | 4/1998 | Mazgarov et al. | |

FOREIGN PATENT DOCUMENTS

| | | |
|---|---|---|
| GB | 763 625 A | 12/1956 |

OTHER PUBLICATIONS

Assalin, et al.; "Treating Light Refinery Products;" The Oil and Gas Journal, vol. 63, No. 1, pp. 90–93.

* cited by examiner

*Primary Examiner*—Bekir L. Yildirim
(74) *Attorney, Agent, or Firm*—Oppenheimer Wolff & Donnelly LLP; Louis C. Cullman

(57) ABSTRACT

The demercaptanizaiton of petroleum distillates can be carried out by sorption of the mercaptan with activated carbon and oxidation of the sorbed mercaptan to disulfide at between approximately 20° C. to 55° C. The activated carbon used in the process is commercially readily available. Its surface area typically ranges from between approximately 500 to 1500 $m^2/g$ and has substantial percentage of the pores in the 10 to 100 Angstrom range.

19 Claims, No Drawings

PROCESS FOR THE DEMERCAPTANIZATION OF PETROLEUM DISTILLATES

CROSS REFERENCE TO RELATED APPLICATIONS

This application claims the benefit of U.S. Provisional Application No. 60/170,422, filed Dec. 13, 1999, which is herein incorporated by reference in its entirety.

FIELD OF THE INVENTION

The invention relates to a novel process for the removal of mercaptan sulfur from petroleum distillates by sorption, or simultaneous sorption and oxidation, over activated carbon, and may be used in petroleum refining for the demercaptanization of gasoline, kerosene, and diesel fractions.

BACKGROUND OF THE INVENTION

Petroleum distillates such as gasoline, naphtha, jet fuel, kerosene, diesel fuel, or fuel oil containing mercaptans are commonly referred to as "sour" and usually are not satisfactory for their intended use. Mercaptans are corrosive and have a highly offensive odor even In minute concentrations.

Mercaptan removal processes can be broadly classified as (i) those involving extraction using an aqueous alkaline solution (usually sodium hydroxide) followed by regeneration of the spent alkaline solution by oxidation of the sodium mercaptides to non-corrosive disulfides, generally in the presence of a catalyst, (ii) and those involving direct catalytic oxidation of the mercaptan to disulfide in the distillate medium itself.

U.S. Pat. No. 1,998,863 discloses a method of non-catalytic regeneration of the spent caustic (used to extract the mercaptans) by elevated temperatures air oxidation. An undesirable side reaction involving hydrolysis of higher mercaptides occurs causing them to be released with the air stream as mercaptans. U.S. Pat. No. 2,324,927 attempts to overcome this disadvantage by separating the distillate into a low boiling and a high boiling fraction and then treating them separately. However, the resultant process scheme appears highly complicated and costly.

More recent patents on mercaptan removal teach the use of a catalyst to speed up the oxidation and possibly lower the required oxidation temperature. The Merox process (Assalin, G. F. and D. H. Starmont, *Oil and Gas Joumal,* 63, pp. 90–93, 1965) uses an iron metal chelate catalyst in an alkaline medium to oxidize mercaptans to disulfides. Oxidation is performed either in the presence of the distillate when sweetening (a process of removing essentially all mercaptan sulfur) only is desired, or in the caustic phase after it has been separated from the distillate when mercaptan extraction is practiced. The catalyst is either in solution in aqueous alkali, or it may be deposited on a solid support in such a manner that it is not soluble in the alkali solution. The disadvantage of the Merox process is in the use of an expensive catalyst involving a chelate and possible contamination of the distillate with the catalyst.

Other patents teach the use of even more exotic and expensive catalysts, such as phthalocyanine catalyst (U.S. Pat. No. 4,250,022), fabric/felt/rope shaped carbon with deposits of Cu, Fe, Ni or Co (U.S. Pat. No. 5,741,415), metal chelate on basic anion exchange resin (U.S. Pat. No. 4,378,305), metal complex of benzophenone tetracarboxylic dianhydride (U.S. Pat. No. 4,243,551) and metal porphyrin or metal azoporphyrin (U.S. Pat. No. 2,966,453). Many of these catalysts provide high activity but are rapidly deactivated in practice.

Use of these exotic, expensive catalysts present the undesirable potential of degrading the distillate quality. Thus an object of this invention is to provide a process based on simple rugged sorbent catalysts (or catalyst impregnated sorbents) that eliminate the potential for distillate degradation, while providing high efficiency for mercaptan removal without deactivation of the catalyst.

BRIEF SUMMARY OF THE INVENTION

In accordance with the present invention, there is provided a process for demercaptanization of mercaptan containing distillates by means of sorption or sorption and oxidation with oxygen or air on commercially available activated carbon (or catalyst impregnated carbon at low temperature (approximately <50° C.). An aqueous alkaline extraxtion step is not used, thus eliminating the use of corrosive sodium hydroxide. The process concept involves the use of high surface area (between approximately 500 to 1500 $m^2/g$) activated carbons that are inexpensive and commercially available in bulk quantities. Preferably, the pores in the carbon should be, but are not limited to, the 10 to 100 Angstrom range. The high surface area and wide pores allows the selective retention of mercaptans in the fine porous structure of the carbon. The carbon also adsorbs a portion of the distillate; however, the catalysts of the present invention exhibit high mercaptan selectivity. As the mercaptan enters the pores, oxygen from air or some other source, also enters the pores. When the mercaptans adsorb on the surface within the pore, oxygen then attacks it to convert it to disulfide, which is highly soluble in oil within the pore. Thus, a concentration gradient allowing influx of the mercaptan into the pores and outflux of the disulfides carried out with the distillate occurs, resulting in a sweet distillate product.

DETAILED DESCRIPTION OF THE INVENTION

One embodiment of the present invention involves a fixed-bed of granular or pelletized activated carbon such as F-400 or BPL from Calgon (Pittsburgh, Pa.). The sour distillate is trickled down through the bed and air is sparged from the bottom in the form of fine bubbles. The bed is maintained at low pressures (typically normal atmospheric) and between approximately 20° C. to 55° C. The sweet distillate will be removed from the bottom. The air stream containing traces of volatile compounds is cleaned by contacting with the sweet distillate. The clean air pressure is slightly boosted above bed pressure and then recycled to the bottom of the fixed bed.

While the following non-limiting examples utilize jet fuel as the source of mercaptan containing distillate, the present invention can be applied to other distillates such as, but not limited to, gasoline, naphtha, kerosene, diesel, and fuel oil. Also, although a fixed-bed is used in one embodiment, moving-beds, fluidized-beds, stirred tanks and other gas-liquid-solid contact configurations can also be used.

The following non-limiting examples will provide the reader, and persons of ordinary skill in the art, a better appreciation and understanding of the present invention.

EXAMPLES

The objective of the tests exemplified herein were to reduce mercaptan levels in jet fuel to a level that would give a negative result for the ASTM Doctor test (D4952-97) and when quantitatively measured using the potentiometric ASTM D3227 test, the mercaptan level will be below 30 ppm. The experimental parameters investigated included temperature (between approximately room temperature (20° C. and 55° C.)), carbon type, time, and the use of air sparging.

Fuel Used

The fuel used was UN1863 Jet Fuel, Aviation Turbine Engine, Moscow Refinery, Moscow, Russia, having a mercaptan content of approximately 50 ppm. The properties of the jet-fuel sample as provided by Moscow Refinery are shown in Table 1. The following commercially available carbons were used:

A. Calgon F-400

B. Calgon High Catalytic Activity Carbon Sample #3092-4-3

C. Carbotech Gmbh Achve Carbon D5214Nox

D. Calgon BPL6×16

Example 1

The original jet fuel was tested to establish mercaptan sulfur content. The fuel tested positive for mercaptan sulfur using the ASTM Doctor test (D4952-97). Quantitative analysis using the ASTM D3227 test indicated that the fuel contained 50 ppm of mercaptan sulfur.

Example 2

A quantity of 50 mL of jet fuel was mixed with 10 g of Carbon A, in a beaker, stirred 5 minutes at room temperature (approximately 20° C.), and filtered. ASTM Doctor test of the resulting fuel was positive indicating an unacceptable mercaptan level.

TABLE 1

| Properties of Jet-Fuel UN1863 from Moscow Refinery | |
|---|---|
| 1. Density (20%) | 0.85 kg/L |
| 2. Fractional Makeup | |
| Distillation Start | 144° C. |
| 10% distilled | 159° C. |
| 50% distilled | 180° C. |
| 90% distilled | 203° C. |
| Final boiling point | 212° C. |
| 3. Mass Sulfur Content | 0.22 wt. % |
| 4. Mercaptan Content | 60 ppm |

Example 3

A quantity of 50 mL of jet fuel was mixed with 10 g of Carbon A, in a beaker, stirred 5 minutes at approximately 50° C., and filtered. ASTM Doctor test of the resulting fuel was positive indicating an unacceptable mercaptan level.

Example 4

A quantity of 50 mL of jet fuel was place in a 600 mL beaker equipped with a magnetic stirrer and an air sparger from the bottom. The beaker was placed on a hot plate and heated slowly while stirring to approximately between 45° C. to 50° C. At this point 20 g of Carbon A was added and the air sparger was started at an air rate of approximately 250 mL/min. The experiment was continued for approximately 15 minutes and stopped. The jet fuel was then filtered. The ASTM Doctor test of the resulting jet fuel was negative indicating an acceptable mercaptan level.

Example 5

A quantity of 50 mL of jet fuel was place in a 600 mL beaker equipped with a magnetic stirrer and an air sparger from the bottom. The beaker was placed on a hot plate and heated slowly while stirring to approximately between 45° C. to 50° C. At this point 20 g of Carbon B was added and the air sparger was started at an air rate of approximately 250 mL/min. The experiment was continued for approximately 15 minutes and stopped. The jet fuel was then filtered. The ASTM Doctor test of the resulting jet fuel was negative indicating an acceptable mercaptan level.

Example 6

A quantity of 50 mL of jet fuel was place in a 600 mL beaker equipped with a magnetic stirrer and an air sparger from the bottom. The beaker was placed on a hot plate and heated slowly while stirring to approximately between 45° C. to 50° C. At this point 20 g of Carbon C was added and the air sparger was started at an air rate of approximately 250 mL/min. The experiment was continued for approximately 15 minutes and stopped. The jet fuel was then filtered. The ASTM Doctor test of the resulting jet fuel was positive indicating an unacceptable mercaptan level.

Example 7

A quantity of 50 mL of jet fuel was mixed with 10 g of Carbon A in a beaker, stirred and left standing for approximately 18 hours at approximately room temperature (20° C.). It was then filtered. The ASTM Doctor test of the resulting jet fuel was positive indicating an unacceptable mercaptan level.

Example 8

A quantity of 50 mL of jet fuel was mixed with 10 g of Carbon D in a beaker, stirred and left standing for approximately 18 hours at approximately room temperature (20° C.). It was then filtered. The ASTM Doctor test of the resulting jet fuel was negative indicating an acceptable mercaptan level.

Example 9

A quantity of 375 mL of fuel was place in a 2-L beaker equipped with a magnetic stirrer and an air sparger from the bottom. The beaker was placed on a hot plate and heated slowly while stirring to approximately between 45° C. to 50° C. At this point 150 g of Carbon A was added and the air sparger was started at an air rate of approximately 250 mL/min. The experiment was continued for approximately 15 minutes and stopped. The fuel was then filtered. The ASTM Doctor test of the resulting jet fuel was negative indicating an acceptable mercaptan level. The carbon retained 47% of the fuel and 53% was recovered during filtration. The jet fuel was quantitatively analyzed using ASTM 3227 potentiometric titration method. This gave a value of 3 ppm mercaptan sulfur indicating that the sample had been desulfurized from 50 ppm mercaptan sulfur to 3 ppm mercaptan sulfur.

Example 10

A quantity of 375 mL of fuel was place in a 2-L beaker equipped with a magnetic stirrer and an air sparger from the bottom. The beaker was placed on a hot plate and heated slowly while stirring to approximately between 45° C. to 50° C. At this point 150 g of Carbon D was added and the air sparger was started at an air rate of approximately 250 mL/min. The experiment was continued for approximately 15 minutes and stopped. The jet fuel was then filtered. The ASTM Doctor test of the resulting jet fuel as negative indicating an acceptable mercaptan level. The carbon retained 41% of the fuel and 59% was recovered during filtration. The fuel was quantitatively analyzed using ASTM 3227 potentiometric titration method. This gave a value of 1-ppm mercaptan sulfur indicating that the sample had been desulfurized from 50-ppm mercaptan sulfur to 1-ppm mercaptan sulfur.

Example 11

An up-flow packed column was prepared containing about 800-cc (450 g) of Carbon D. The column was a 1.5-inch×36-inch high stainless steel tube. External controlled heat was supplied to the column to control the bed temperature. The fuel flow to the column was set at 13.35 cc/min to achieve a liquid hourly space velocity of about 1.8 cc/g/h. Air flow was varied between 25 to 100 cc/min. Fuel and air were mixed and flowed up co-currently through the column. A number of mercaptan doped jet fuel samples and the jet fuel of Table 1 were tested.

1-Decanethiol (Decyl mercaptan)(D1) and cyclohexyl: mercaptan (D-2) were used as the mercaptan doping agents to test both straight chain and cyclic mercaptans. The test conditions and mercaptan removal results achieved are shown in Table 2. The runs are listed in the order in which they were conducted. All experiments were conducted at 1 atm pressure. The mercaptan analysis was conducted using ASTM D-3227.

TABLE 2

Mercaptan removal in a continuous flow packed column of Carbon D

| Duration (hours) | Average Temperature (° C.) | Air Flow (cc/min) | Fuel | Doping Agent | Mercaptan Sulfur In (ppm) | Mercaptan Sulfur Out (ppm) |
|---|---|---|---|---|---|---|
| 6.7 | 45 | 50 | F1 | D1 | 50 | 2.3–14.0 |
| 5.0 | 54 | 50 | F1 | D1 | 50 | 8.6 |
| 3.5 | 54 | 25 | F1 | D1 | 50 | 8.4 |
| 3.4 | 53 | 100 | F1 | D1 | 50 | 8.7 |
| 3.4 | 62 | 50 | F1 | D2 | 43 | 6.8–23 |
| 2.2 | 61 | 25 | F1 | D2 | 43 | 18 |
| 4.3 | 63 | 100 | F1 | D2 | 43 | 13 |
| 2.2 | 60 | 50 | F1 | D2 | 43 | 22 |
| 3.2 | 71 | 50 | F1 | D2 | 50 | 13 |
| 3.0 | 70 | 100 | F1 | D2 | 50 | 8.7 |
| 3.9 | 77 | 100 | F2 | None | 44 | 6 |
| 4.1 | 54 | 50 | F3 | None | 23 | 11 |
| 2.5 | 89 | 25 | F2 | None | 41 | 1.9 |

(1)

F1: Prist Aviation Fuel

F2: Russian Aviation Fuel (Table 1)

F3: 50:50 F1and F2

D1: 1-Decanethiol

D2: Cyclohexyl Mercaptan

The example shows that after 47 hours of running at a range of conditions, the mercaptan was reduced to below jet fuel specs of 30 ppm.

Example 12

The samples for Run 11 (Row No. 11) in Table 2 were analyzed independently by Saybolt, Incorporated, Wilmington, N.C. The results of feed and treated samples are shown in Table 3.

The results indicate that except for significant reduction in mercaptan sulfur and some reduction in total sulfur, there is not a significant property change between the in and the out jet fuel samples.

The results indicate that except for significant reduction in mercaptan sulfur and some reduction in total sulfur, there is not a significant property change between the in and the out jet fuel samples.

Activated carbon type (or catalyst impregnated carbon), time, temperature, and the use of air sparging are important parameters of the invention, the combination of which can be optimized for a maximum efficiency for a particular distillate to be demercaptanized. The activated carbons used are rugged commercial samples that do not break apart and contaminate the distillate. The indicated advantages of the simple one-step mild to low temperature, low pressure process proposed using rugged/inexpensive sorbent-catalysts as compared to known processes, allow significant improvements to be made in the demercaptanization industry by providing an inexpensive and technically superior method of achieving the demercaptanization objective.

It will be apparent to one of ordinary skill in the art that many changes and modifications can be made in the invention without departing from the spirit or scope of the appended claims.

What is claimed is:

1. A process for removing mercaptans from disillates comprising:

contacting distillates having mercaptans to activated carbons without the addition of an alkalizing compound, wherein said activated carbons selectively adsorb said mercaptans; and providing oxidizing agents that react with said selectively adsorbed mercaptans.

2. The process of claim 1 wherein said activated carbons are arranged in a configuration selected from the group consisting of fixed-beds, moving-beds, fluidized-beds, and stirred tanks.

3. The process of claim 1 wherein said activated carbons are arranged in a configuration having a surface area of at least 500 m2/g.

4. The process of claim 1 wherein said activated carbons are arranged in a configuration having a surface area approximately between 500 to 1500 m2/g.

5. The process of claim 1 wherein said activated carbons further include a plurality of pores, said plurality of pores having a pore size approximately between 10 to 100 Angstroms.

6. The process of claim 1 wherein said distillates are selected from the group consisting of jet fuel, gasoline, naphtha, kerosene, diesel gasoline, and fuel oil.

7. The process of claim 1 wherein said oxidizing agents are selected from the group consisting of air, oxygen, and hydrogen peroxide.

8. The process of claim 1 further comprising maintaining said process at a temperature of at least 20° C.

9. The process of claim 1 further comprising maintaining said process at a temperature within the range of approximately 20° C. to 55° C.

10. A process for removing mercaptans from petroleum distillates comprising:

providing at least one surface of activated carbons;

contacting said petroleum distillates having mercaptans to said at least one surface of activated carbons without the addition of an alkalizing compound, said at least one surface of activated carbon selectively adsorbing said mercaptans; and exposing said petroleum distillates to oxidizing agents, wherein said oxidizing agents oxidize said adsorbed mercatans.

11. The process of claim 10 wherein said at least one surface of activated carbons is selected from the group consisting of fixed-beds, moving-beds, fluidized-beds, and stirred tanks.

12. The process of claim 10 wherein said reagents are selected from the group consisting of air, oxygen, and hydrogen peroxide.

13. The process of claim 10 further comprising maintaining said process at a temperature of at least 20° C.

14. The process of claim 10 further comprising maintaining said process at a temperature within the range of approximately 20° C. to 55° C.

15. The process of claim 10 wherein said surface area of activated carbons further includes a plurality of pores, said plurality of pores having a pore size approximately between 10 to 100 Angstroms.

16. The process of claim 10 wherein said activated carbons are arranged in a configuration having a surface area of at least 500 m2/g.

17. The process of claim 10 wherein said activated carbons are arranged in a configuration having a surface area approximately between 500 to 1500 m2/g.

18. The process of claim 10 wherein said petroleum distillates is selected from the group consisting of jet fuel, gasoline, naphtha, kerosene, diesel gasoline, and fuel oil.

19. A process for removing mercaptans from petroleum distillates comprising:

providing at least one fixed-bed of activated carbons, said activated carbons having a pore size within the range of approximately between 10 to 100 Angstroms;

adding petroleum distillates having mercaptans to said fixed bed of activated carbons without the addition of an alkalizing compound, said fixed bed of activated carbons selectively adsorbing said mercaptans; and applying an air stream to said at least one fixed bed, said air stream oxidizing said selectively adsorbed mercaptans at a temperature within the range of approximately 20° C. to 55° C.

* * * * *